US006138541A

United States Patent [19]

Krampitz

[11] Patent Number: 6,138,541

[45] **Date of Patent: *Oct. 31, 2000**

[54] METHOD FOR DEFLECTING WIRE-ROD STRAND

[75] Inventor: Michael Krampitz, Magdeburg, Germany

[73] Assignee: SKET Walzwerkstechnik GmbH, Magdeburg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 09/115,136

[22] Filed: Jul. 14, 1998

[30] Foreign Application Priority Data

Jul. 16, 1997 [DE] Germany ..... 197 30 375

[51] Int. Cl.[7] ..... B26D 7/06

[52] U.S. Cl. ..... 83/107; 83/102; 83/950

[58] Field of Search ..... 83/102–107, 950

[56] References Cited

U.S. PATENT DOCUMENTS

| | | | |
|---|---|---|---|
| 3,612,270 | 10/1971 | Lee et al. | 83/74 |
| 3,969,668 | 7/1976 | Weinzinger et al. | 72/10 |
| 4,966,060 | 10/1990 | Poloni | 83/105 |
| 5,690,008 | 11/1997 | Pong | 83/26 |

FOREIGN PATENT DOCUMENTS

| | | |
|---|---|---|
| 0 297 313 | 1/1989 | European Pat. Off. . |
| 129 127 | 12/1977 | Germany . |
| 145 237 | 12/1980 | Germany . |
| 145503 | 12/1980 | Germany . |
| 3523046 | 2/1986 | Germany . |
| 218 852 | 10/1993 | Germany . |

OTHER PUBLICATIONS

Chanian, "Physics," Showing Magentic Field Lines, Arcs, as Shown in p. 792, Fig. 35.19, 1985.

*Primary Examiner*—Lee Young
*Assistant Examiner*—Rick Kiltae Chang
*Attorney, Agent, or Firm*—Collard & Roe, P.C.

[57] ABSTRACT

A device for deflecting wire-rod strand moving at high speed. The invention permits the safe deflection of any lengths of the wire-rod strand especially at high product speeds. High forces adjustable within wide limits are temporarily applied to the product without substantially reducing the kinetic energy of the product or impairing its smooth travel. The high forces are electromagnetic forces which are applied temporarily to the wire-rod rolling stock perpendicular to the direction of product travel. These forces are generated by a current flowing through the product and a stationary current conductor opposing the wire-rod strand in approximately the same plane. The electromagnetic forces deflect the wire-rod strand away from the current conductor. In addition, a second device may be placed opposite the first device to apply an opposing force to the wire-rod strand.

5 Claims, 6 Drawing Sheets

METHOD FOR DEFLECTING WIRE-ROD STRAND

BACKGROUND OF THE INVENTION

1. Field of the Invention

The present invention relates to a method and a device for deflecting wire-rod strand moving at high speed.

2. Description of the Prior Art

It is known that during the mill process, wire-rod traveling through a mill train is cropped or separated either to improve the conditions of entering downstream mill stands, or to separate lengths of rod which do not meet the quality requirements and discard such lengths as scrap.

The cropping or separating of wire-rod strand is carried out by means of so-called flying shears. Such flying shears operate at extremely high revolutions per minute. See EP 297,313 B1 and DE 3,523,046 A1 patents. Such shears, however, represent highly complicated mechanical systems. Due to the high product speeds, the shear blades and the switch components are subjected to rapid mechanical wear. At product speeds of more than 80 m/s, such a system can only be controlled with sophisticated electronic equipment. In addition, the switch systems have to be located at considerable distance away from any cutting and sorting device so as to account for the switching delay.

Furthermore, it is known to guide the wire-rod strand by means of switches to downstream machines, or to feed cropped ends to suitable scrap disposal means. The switches are driven by means of hydraulic cylinders, pneumatic cylinders, moving screws, electric motors, or by a combination of such devices. As mentioned above, the greatest problem of the switch systems is the need for a short switching time particularly at high product speeds. Typically, the switching time is less than 1/10 of a second.

An additional device for deflecting the wire-rod strand is a deflector flap. This device, however, has several drawbacks. First, direct contact of the product with the guiding means may cause the wire-rod strand to break out of the guides at high product speeds. Moreover, direct contact may result in damage to the product. Such a disadvantageous guiding system for deflecting the wire-rod strand was disclosed in DE 3,523,046, where the guiding system is brought into contact with the product in order to guide the latter into appropriate guide runners.

In order to avoid the drawbacks outlined above, foreign patent DD 145,503 deflects the wire-rod product by applying a force to the latter by means of an external magnetic field surrounding the product. Such a magnetic field is generated by a magnet coil of a suitably selected size, and a current flowing through the product. The drawback of this design is that considerable technical means are required for generating the magnetic field. In addition, the magnetic field in the magnet coil is not very strong due to the large dimensions of the coil and the relatively large spacing from the magnetic field of the wire-rod strand. Another disadvantage results from the application of current to the magnetic coil and the product via sliding contacts. Such a configuration results in rapid wear especially at high product speeds. Furthermore, it is not clear how the wire-rod strand is to be held against the sliding contacts. Consequently, such a configuration is only suitable for a limited number of applications.

SUMMARY OF THE INVENTION

It is an object of the present invention to increase the efficiency and throughput of mill trains. It is another object of the invention to provide a simple and cost effective solution to deflect wire-rod strand.

In particular, the object of the invention is to provide safe deflection of any lengths of the wire-rod strand at product speeds in excess of 80 m/s. To achieve this object, electromagnetic forces, adjustable within wide limits, are temporarily applied to the product without considerably reducing the kinetic energy of the product or impairing the smooth traveling. An electromagnetic force is applied to the product perpendicular to the direction of product travel. When current flows, in opposite directions, through conductive materials, a resulting electromagnetic force deflects the two materials away from each other. In the present case, such a force is generated by a current flowing through the product in one direction and the same current flowing in the opposite direction through a current conductor. The current conductor is arranged in approximately the same plane as the product.

In a particularly advantageous implementation of the deflection method, an electric current is transmitted to the product by means of an arc. The resulting arc does not physically contact the product. As a result of the application of current via an arc, the spacing between the wire-rod strand and the electrical conductor is small and high magnetic forces are generated. It is particularly advantageous and suitable if a high electromagnetic force is temporarily applied to a predetermined length of the wire-rod strand. The electric arc is applied to the product for a period of approximately $10^{-4}$ seconds; however, this is not to be construed as a limitation as varying periods will have advantageous effects. In addition, the temporary application of current reduces any scorching effect on the product.

It is another object of the invention to deflect the wire-rod strand by means of an electromagnetic force of such magnitude that the product is automatically divided upon impacting a shearing element. The shearing element is either stationary or it is moving at the product speed in the direction of product travel. The electromagnetic cutting effect is especially advantageous in that energy expended in moving large cutting masses is eliminated and other expensive drives and control technology can be omitted.

Another object of the invention is to utilize the acting electromagnetic force as a deflecting force for guiding the product in a direction other than the direction of product travel. The electromagnetic force is used here to produce a high-speed switch. The advantage of utilizing the invention as a switch lies in the faster switch response. It is therefore possible to keep the spacing between the switch and additional upstream equipment, for example between a shear and the switch as defined by the invention, extremely small. Furthermore, the number of parts subject to wear is significantly reduced.

Another object of the invention is to utilize a defined opposing electromagnetic force which, during deflection of the product, prevents the latter from striking against guiding means of the mill train. Such a configuration precludes the known drawbacks associated with such unwanted physical contact.

The invention also relates to a device for deflecting the wire-rod strand, the invention comprising a current conductor disposed adjacent to the product and in approximately the same plane as the latter. The current conductor is fitted with a first contact electrode. The current conductor is in turn connected to a second contact electrode via a current source, a capacitor and a triggered switching spark gap, with the contact electrodes being spaced from the product such that an arc can be generated between the latter and each contact electrode. This special arrangement ensures that there is minimal spacing between the current conductor and the product. Such a configuration makes it possible to transmit the required currents of up to $10^5$ A to the wire-rod strand, and to take advantage of the large magnetic field generated around the current conductor.

According to another embodiment of the invention, provision is made that the current conductor is designed in a straight line except arranged at a defined angle relative to the product. In addition, the current conductor may have a defined curved shape or different cross sections over its length. These modifications can maximize the effect of force on a defined area, and is especially advantageous if the device is employed as a high-speed shearing device. In this case, the device for deflecting the product as defined by the invention comprises an associated shearing element, which is located opposite to the product in the zone of deflection in such a way that the wire-rod strand can pass in the same plane between the deflecting device and the shearing element. In this arrangement, the latter may be stationary or movable in the direction of product travel.

Furthermore, it is recommended that the shearing element be designed in the form of an anvil with a cutting edge assisting in performing the cutting operation.

In another embodiment, it is possible to arrange the device for deflecting the product as a high speed electromagnetic switch. The switch would be located directly upstream of the zone of deflection from the passline.

In another embodiment, it may be useful to arrange a second device, providing identical function for deflecting the product, in a mirror-inverted configuration on the other side of the passline opposite to the first device for deflecting the product. This would prevent the deflected product from striking guiding means thereby causing damage to the device or the product. The second device would have the same function as the first one and be associated with the latter.

BRIEF DESCRIPTION OF THE DRAWINGS

Other objects and features of the present invention will become apparent from the following detailed description considered in connection with the accompanying drawings which disclose several embodiments of the present invention. It should be understood, however, that the drawings are designed for the purpose of illustration only and not as a definition of the limits of the invention.

The drawings show the mode of operation of the device for deflecting wire-rod product which, in the present embodiment, is arranged upstream of a looplayer not shown in detail. According to the invention, the deflecting device can be used as a high-speed shear and/or high-speed switch in order to separate scrap stock from acceptable product.

In the drawings, wherein similar reference characters denote similar elements throughout the several views:

FIG. 1 is an embodiment wherein the wire-rod strand enters the zone of the device for deflecting the product;

FIG. 2 is an embodiment wherein the head end of the product strand, which does not meet the quality requirements, is deflected to pass into the scrap track;

FIG. 3 is an embodiment wherein a force is generated to divide the product crosswise;

FIG. 4 is an embodiment wherein the head end of the product strand is being diverted into the scrap track;

FIG. 5 is an embodiment wherein the product enters the looplayer; and

FIG. 6 is an additional embodiment wherein an additional deflecting device is disposed adjacent to the first deflecting device.

DETAILED DESCRIPTION OF PREFERRED EMBODIMENTS

Figure 1:
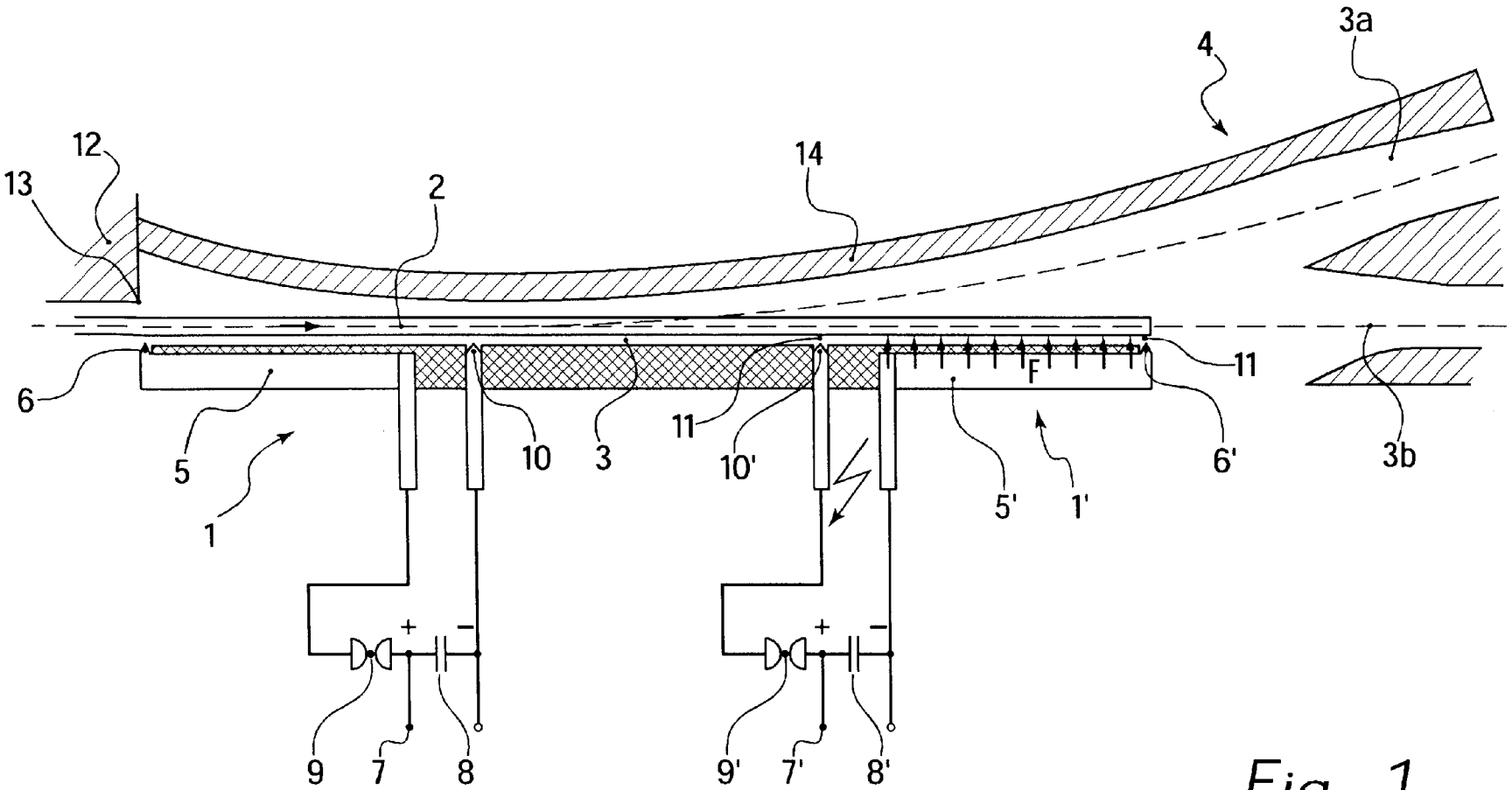

Referring to FIG. 1, there is shown a device 1 for deflecting wire-rod strand 2. The device 1 is positioned perpendicular to the passline and upstream (when facing the mill train) in the direction of product travel of a looplayer not shown in detail. Between device 1 and the looplayer, product guide 3 feeds into funnel-shaped guiding means 4 and bifurcates into a scrap guide 3*a* and an acceptable product guide 3*b*. The scrap guide 3*a* passes away from the passline at a suitable angle. Another device 1' for deflecting the product strand 2 can be arranged between device 1 and the looplayer in the immediate vicinity of the funnel-shaped guiding means 4 of product guide 3. The devices 1 and 1' for deflecting the product strand 2 consist of a stationary current conductor 5 opposing product strand 2 in approximately the same plane. This current conductor 5 in turn has a first contact electrode 6 pointing in the direction of product strand 2 and being connected via a current source 7, capacitor 8 and a triggered switching spark gap 9 to a second contact electrode 10 also pointing in the direction of product strand 2. The spacing between product strand 2 and contact electrodes 6 and 10 is chosen so that an arc 11 can be generated between product strand 2 and each contact electrode 6 and 10.

The head end of the product strand 2 moving at high speed has already traveled past device 1 and reached the identically designed device 1'. The previously charged capacitor 8' is discharged at this instant via switching spark gap 9' which functions as a switch. An arc 11 is ignited on each of electrodes 6' and 10', and the power circuit is closed.

When the power circuit is closed, current flows through the stationary current conductor 5' in a first direction. The current then arcs 11 across the first contact electrode 6' and moves in a second direction until it reaches a second contact electrode 10'. The current then flows back to the current source 7'.

It is known that a magnetic force is applied to electric charges which move in an external magnetic field. The flow of current in the stationary current conductor creates a magnetic field which surrounds the current conductor. As the wire-rod strand carries current and is placed inside the magnetic field created by the stationary current conductor, an equal and opposing force is exerted upon the product and the stationary current conductor. Since the stationary current conductor is fixed relative to the product, the resulting force displaces the product. The current flowing through the stationary current conductor and that flowing through the product are in opposite directions and therefore the resulting force is applied to the product in a direction away from the stationary current conductor.

The magnetic fields generated in both product strand 2 and current conductor 5' produce a repelling magnetic force acting on the current-conducting parts, so that a force "F" acting perpendicular to the passline and the current conductor deflects the head end of the product strand towards scrap guide 3*a*.

Figure 2:
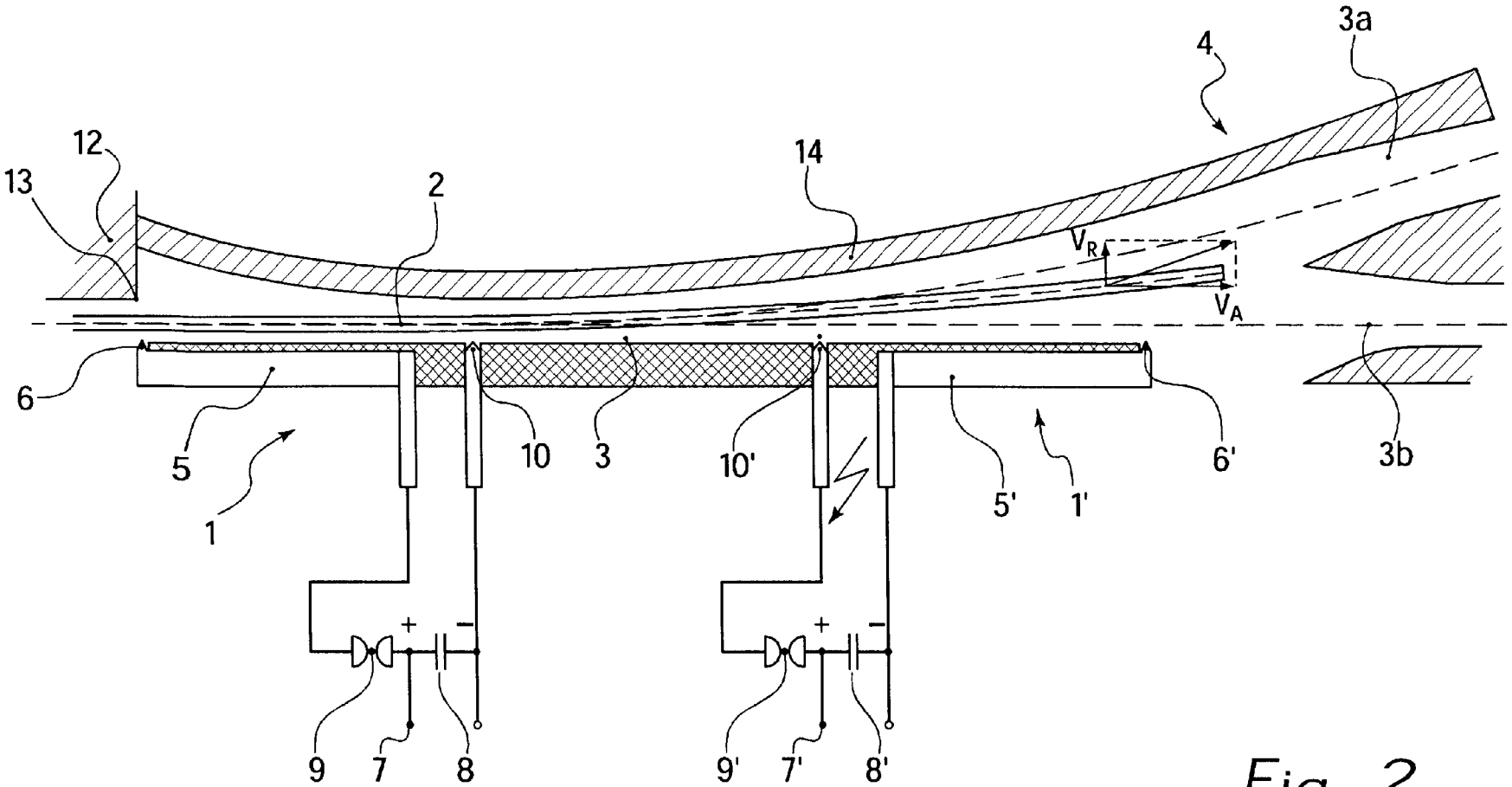

Referring to FIG. 2, there is shown the relative movement of the head end of the product strand which is composed of axial movement ($V_A$) of product strand 2, and radial motion ($V_R$) of the product head end. Entry of the product head end is assisted by the funnel-shaped design of scrap guide 3*a*. Hence, in this application device 1' functions as a high-speed switch.

Figure 3:
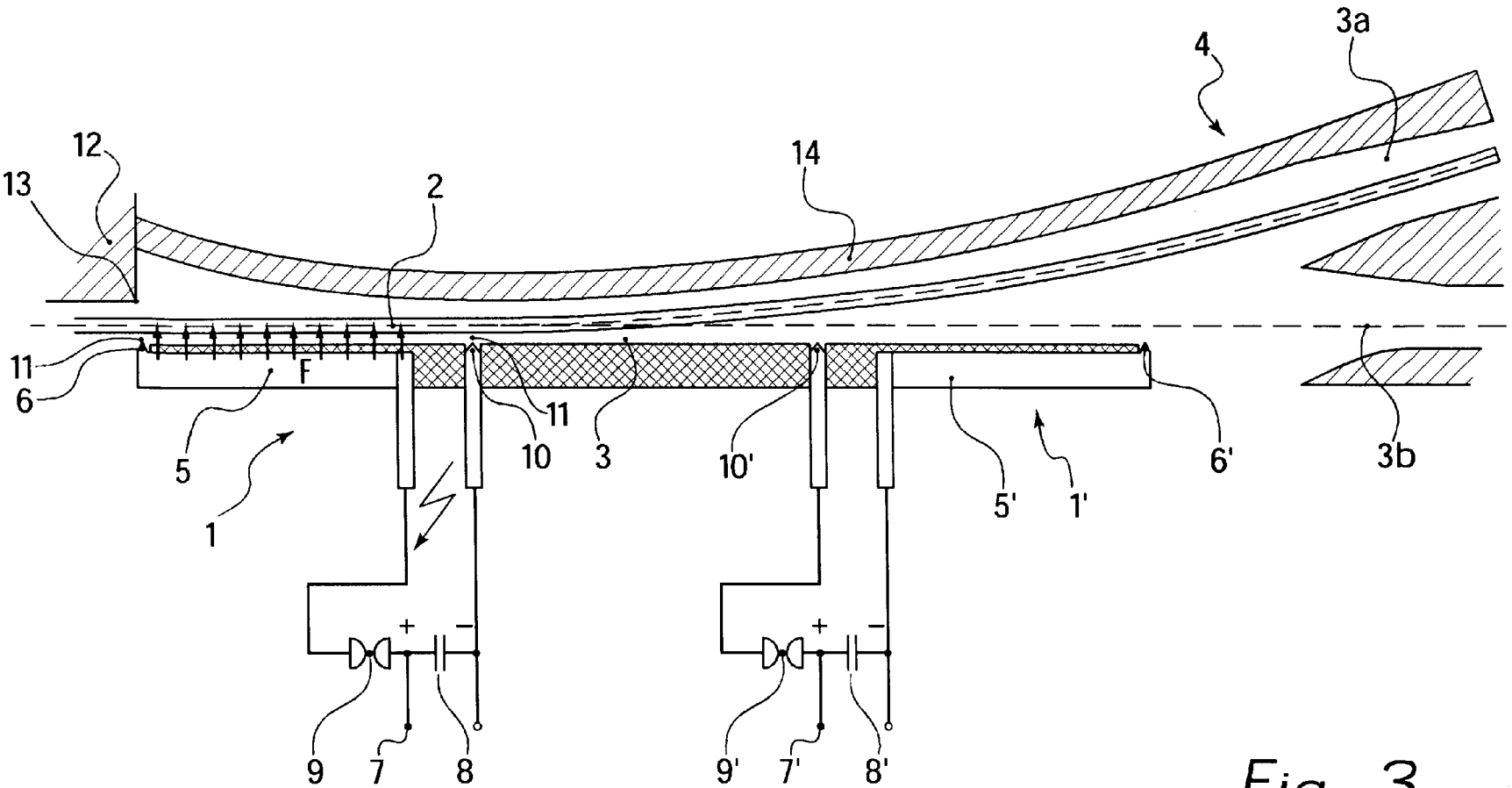

Referring to FIG. 3, there is shown defective product 2 which has entered scrap guide 3*a* far enough to separate from acceptable product. Capacitor 8 associated with switching spark gap 9 of upstream device 1 is discharged via the spark gap for deflecting wire-rod strand 2. On the associated contact electrodes 6 and 10, arcs 11 ignite due to the high-voltage potential transmitting current from capacitor 8, causing the electromagnetic open circuit to be closed in an extremely short time.

Figure 4:
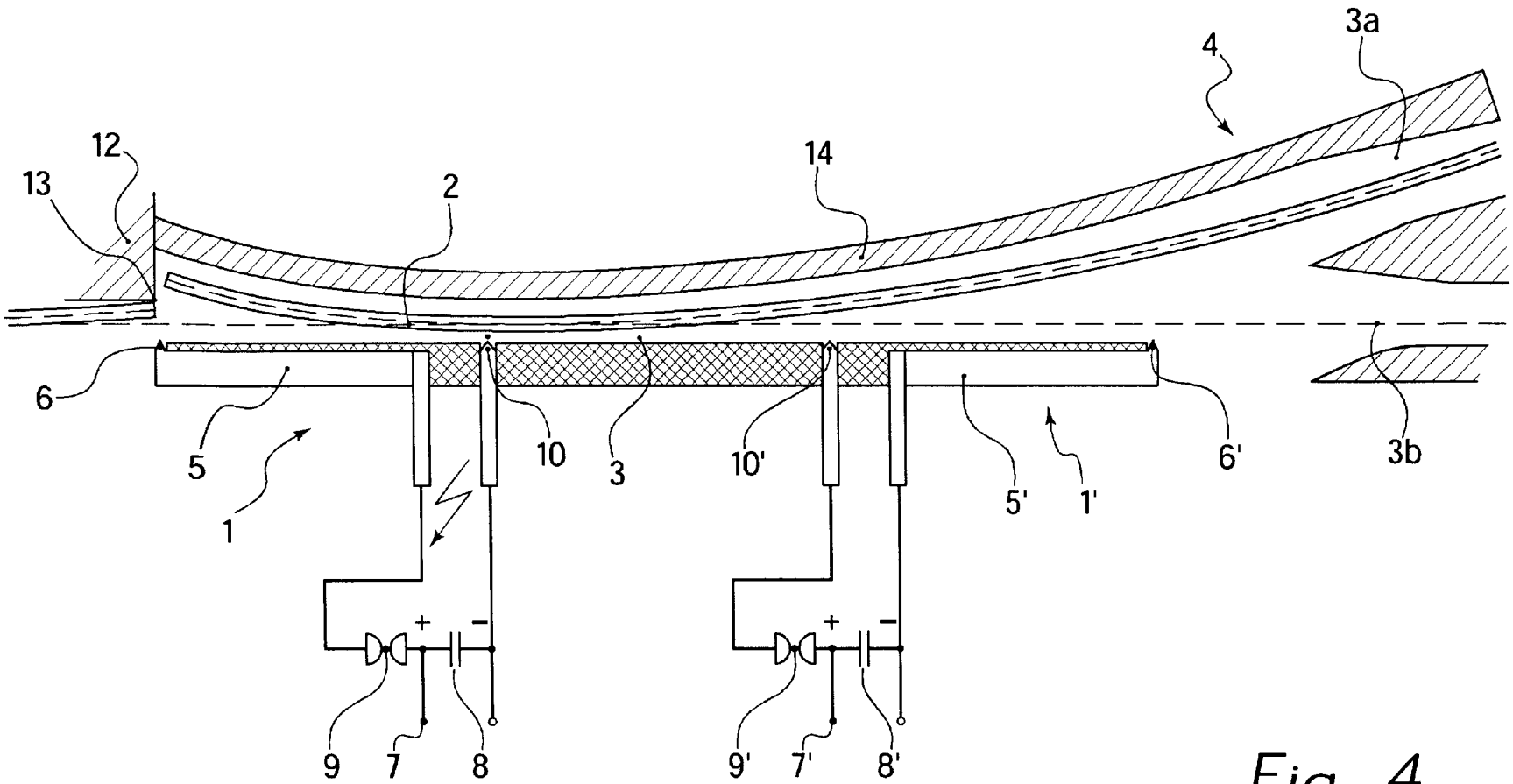

Referring to FIG. 4, there is shown an embodiment of the invention which acts as a cutting device for the product. The magnetic fields generated by current flowing in opposite directions through the current conductor and the product cause a repelling magnetic force to act on the current-conducting parts, so that the wire-rod strand impacts a shearing element 12 arranged in the zone of deflection of the product strand 2 and opposing device 1 in approximately the same plane. The repelling magnetic force acts perpendicular to the passline and away from current conductor 5. Force "F", which is used to implement high-speed shearing means through the defined discharge of the capacitor current, is adjusted sufficiently high to cause the wire-rod strand 2 to automatically cut itself crosswise.

In the present case, shearing element 12 is arranged stationarily. It is designed in the form of an anvil and provided with a cutting edge 13 supporting the cut. However, it may be advantageous under certain circumstances to move shearing element 12 at product speed in the direction of product travel and then perform the cut at a suitable point in order to minimize the braking effect on the product 2 as the cut is being made.

Furthermore, it is possible to modify current conductor 5 itself in such a way that the repelling magnetic force is focused on any defined zone or area of product 2 also in relation to shearing element 12. For example, current conductor 5 may be designed in a straight line, but arranged at a defined angle relative to the product strand 2, or current conductor 5 may have a defined curved shape in the plane, and/or current conductor 5 may have different cross sections over its length. The intensity and effect of the magnetic fields can be influenced by these measures in specific zones or areas.

Figure 5:
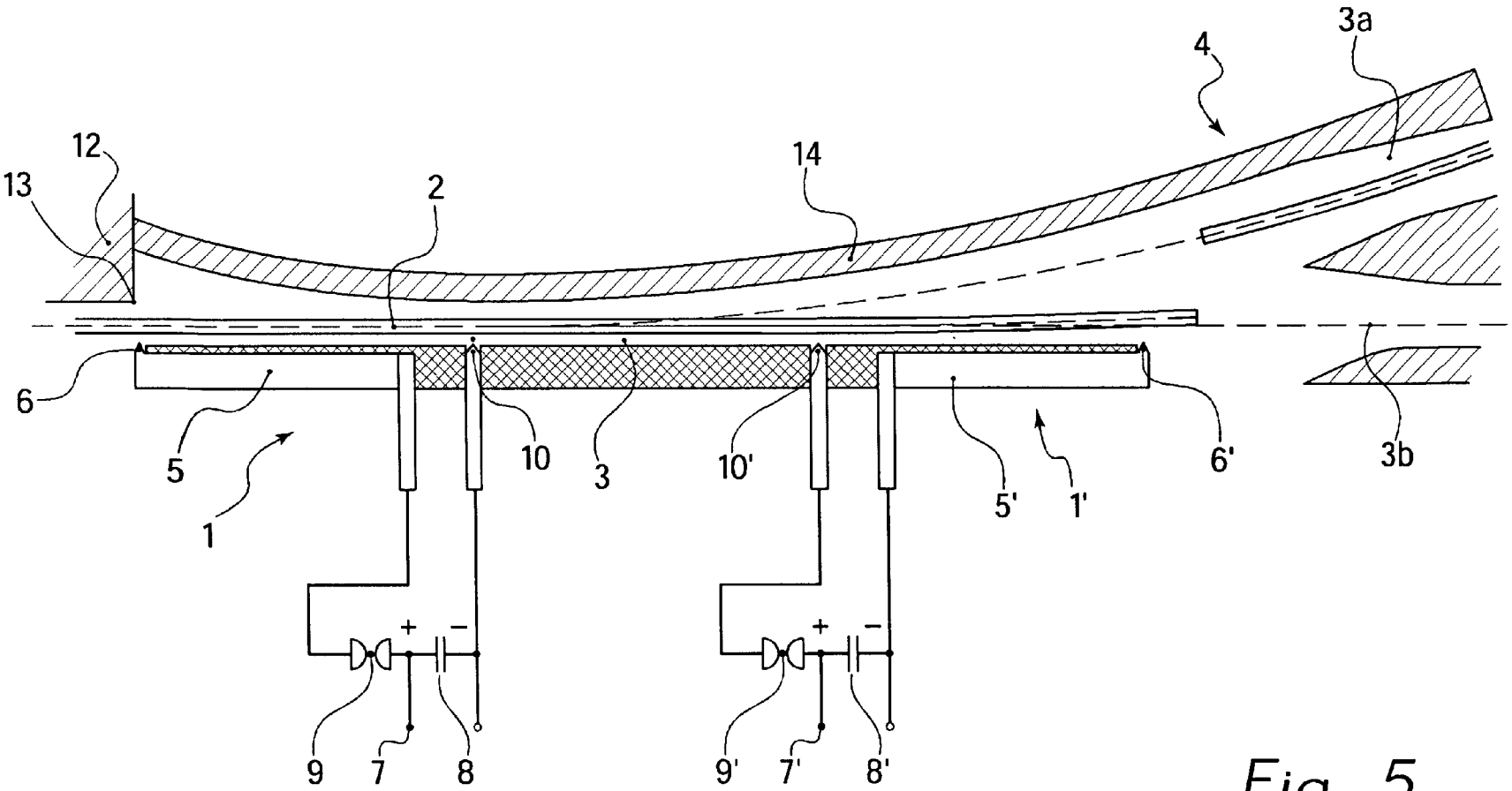

Referring to FIG. 5, there is shown an embodiment of the invention in which the strand of product is now guided in the passline through product guide 3*b* to the looplayer, which is not shown in detail and is known per se. Any slight deformation that may occur on the product head end is compensated for by the funnel-shaped entry end of the product guide. The tail end of the product strand 2, which may have quality deficiencies, is separated from the strand of product and admitted into scrap guide 3*a*. As described above, this is accomplished by means of the devices 1, 1' as defined by the invention, except in the reverse sequence.

Figure 6:
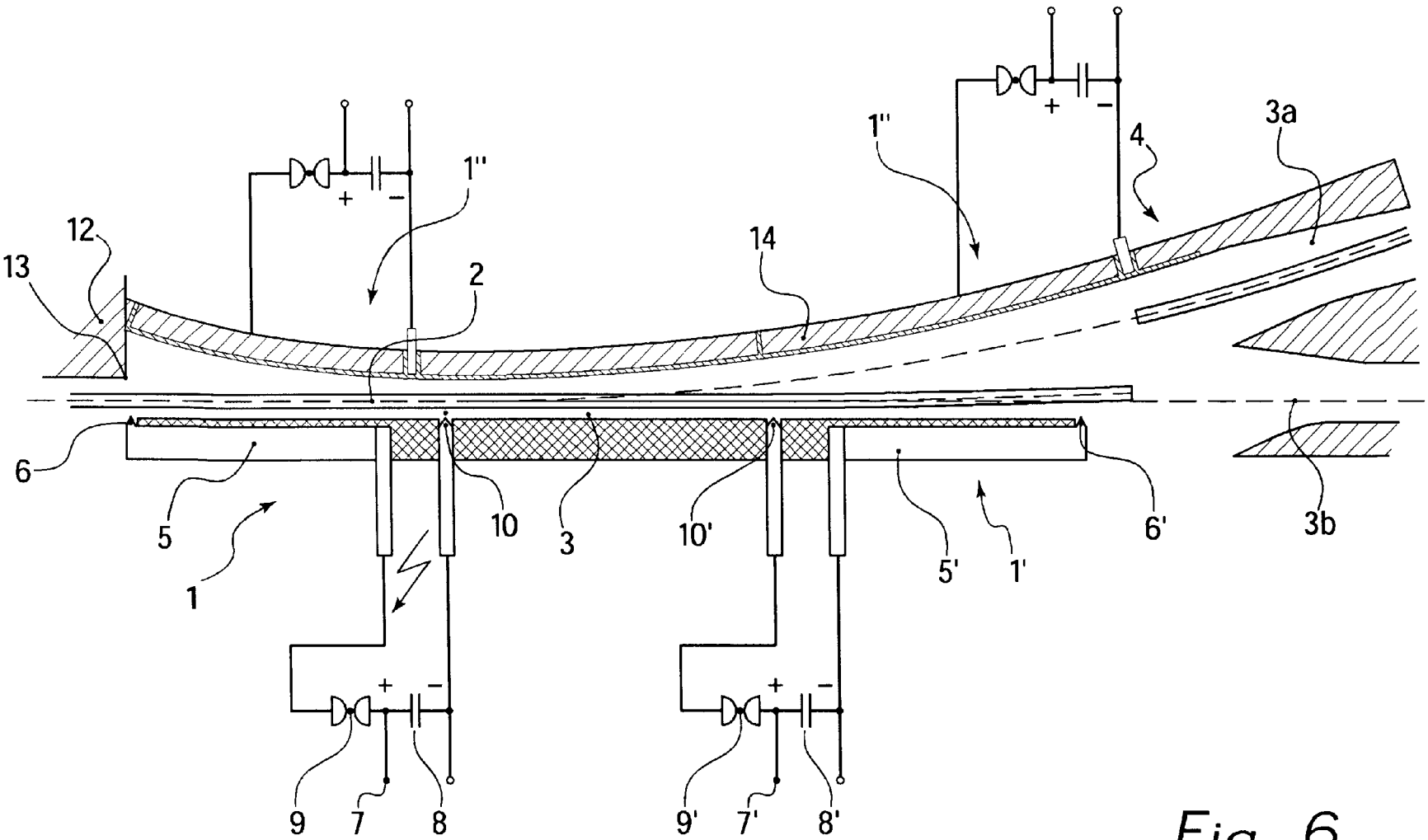

Referring to FIG. 6, there is shown an embodiment which is a useful arrangement whose particular purpose is to prevent the product strand 2 from striking against guiding means 14 while it is being deflected.

According to the invention, an additional device 1" having a function identical to that of devices 1, 1' may be associated with each of said devices, and may be arranged on the opposite side. The additional device generates an opposing force preventing collisions of the product strand 2 as described above. Devices 1 and 1" as well as 1' and 1" are controlled with respect to time and also in their action of force in such a way that they will not adversely influence each other.

It is, of course, understood that devices 1, 1' and 1" of the type as defined by the invention may be arranged also in additional or other suitable locations of the passline in order to deflect wire-rod strand 2; i.e., the invention is not limited to the embodiment described above.

While several embodiments of the present invention have been shown and described, it is to be understood that many changes and modifications may be made thereunto without departing from the spirit and scope of the invention as defined in the appended claims.

What is claimed is:

1. A method for deflecting wire-rod strand moving in a direction at high speed, comprising the steps of:

applying a high current, high voltage electric potential to a current conductor disposed in a plane opposite to the wire-rod strand, the current conductor having a first electrode and a second electrode in a direction of movement of the wire-rod strand, said first electrode being electrically connected to said second electrode, the electric connection between the first and second electrodes being realized via a current source, a capacitor and a triggered switching spark gap;

inducing a high current flow in a first direction across said current conductor;

placing the wire-rod sufficiently close to said current conductor, the wire-rod strand being separated by a space from the first and second electrodes; and producing between the wire-rod strand and said electrodes an electric arc to close the space between the wire-rod strand and the first and second electrodes and to transmit without contact an electric current to the wire-rod strand so as to induce said high current flow in a second direction opposite to said first direction across the wire-rod strand, thereby generating an electromagnetic force between the wire-rod strand and said current conductor, said force being perpendicular to the plane of the current conductor, thereby deflecting the wire-rod strand away from said current conductor.

2. The method according to claim 1, further comprising the step of:

applying said electromagnetic force temporarily to a predetermined length of the wire-rod strand.

3. The method according to claim 1, further comprising the steps of:

deflecting the wire rod strand by means of an electromagnetic force of high intensity; and impacting the wire rod strand with a shearing element to separate the wire rod strand.

4. The method according to claim 1, further comprising the step of:

guiding the wire-rod strand in a direction other than the direction of movement of said wire-rod strand.

5. The method according to claim 1, further comprising the step of:

applying an opposing electromagnetic force wherein said opposing force, in a course of deflection of wire-rod strand, prevents an end of said wire-rod strand from striking guiding means of a mill train.

* * * * *